US009731940B2

(12) United States Patent
Ooms

(10) Patent No.: US 9,731,940 B2
(45) Date of Patent: Aug. 15, 2017

(54) STAIR LIFT

(71) Applicant: Otto Ooms B.V., Bergambacht (NL)

(72) Inventor: Alex Ooms, Bergambacht (NL)

(73) Assignee: Otto Ooms B.V., Bergambacht (NL)

( * ) Notice: Subject to any disclaimer, the term of this patent is extended or adjusted under 35 U.S.C. 154(b) by 345 days.

(21) Appl. No.: 14/396,950

(22) PCT Filed: May 8, 2013

(86) PCT No.: PCT/NL2013/050348
§ 371 (c)(1),
(2) Date: Oct. 24, 2014

(87) PCT Pub. No.: WO2013/169108
PCT Pub. Date: Nov. 14, 2013

(65) Prior Publication Data

US 2015/0107939 A1 Apr. 23, 2015

(30) Foreign Application Priority Data

May 10, 2012 (NL) ..... 2008786

(51) Int. Cl.
*B66B 9/08* (2006.01)

(52) U.S. Cl.
CPC ..... *B66B 9/0853* (2013.01); *B66B 9/08* (2013.01); *B66B 2009/0892* (2013.01)

(58) Field of Classification Search
CPC .. B66B 9/0853; B66B 9/08; B66B 2009/0892
USPC ..... 187/201
See application file for complete search history.

(56) References Cited

U.S. PATENT DOCUMENTS 3,820,844 A * 6/1974 Fortnam ..... A47C 7/52 297/240
5,255,957 A * 10/1993 Opsvik ..... A47C 9/005 297/423.12
5,533,594 A * 7/1996 Tremblay ..... B66B 9/0838 187/201
5,992,935 A * 11/1999 Duijnstee ..... B66B 9/08 297/344.21
8,550,215 B2 * 10/2013 Linton ..... B66B 9/0853 187/201
9,101,221 B2 * 8/2015 LaPointe ..... A47C 7/506
(Continued)

FOREIGN PATENT DOCUMENTS

DE 202012100417 3/2012
JP 2008100789 5/2008
WO WO-2005085115 9/2005

*Primary Examiner* — Michael Riegelman
(74) *Attorney, Agent, or Firm* — Marcus C. Dawes; Daniel L. Dawes

(57) ABSTRACT

A stair lift comprising a rail which is mounted along the staircase, at least partially at an angle to the horizontal plane, and a frame which is movable along the rail, on which a chair is mounted, which frame is provided with support and drive means that engage the rail, wherein the chair is rotatable about a vertical axis relative to the frame between two extreme rotated positions, wherein the chair comprises a seat on which a person can be seated and wherein the chair comprises a footrest on which a person seated on the seat can rest his or her feet, wherein the seat and the footrest are rotatable at mutually different angles about the vertical axis.

5 Claims, 7 Drawing Sheets

(56) References Cited

U.S. PATENT DOCUMENTS

| | | | | |
|---|---|---|---|---|
| 2007/0235265 | A1* | 10/2007 | Vroegindeweij | B66B 9/0838<br>187/201 |
| 2007/0272488 | A1* | 11/2007 | Woodhams | B66B 9/0846<br>187/201 |
| 2007/0284194 | A1* | 12/2007 | Woodhams | B66B 9/0853<br>187/202 |
| 2011/0133527 | A1* | 6/2011 | Taylor | A47C 7/506<br>297/183.1 |

* cited by examiner

STAIR LIFT

The invention relates to a stair lift comprising a rail which is mounted along the staircase, at least partially at an angle to the horizontal plane, and a frame which is movable along the rail, on which a chair is mounted, which frame is provided with support and drive means that engage the rail, wherein the chair is rotatable about a vertical axis relative to the frame between two extreme rotated positions, wherein the chair comprises a seat on which a person can be seated and wherein the chair comprises a footrest on which a person seated on the seat can rest his or her feet. The invention also relates to a frame for a stair lift which is movable along the rail which is mounted along a staircase at least partially at an angle to the horizontal plane, on which frame a chair is mounted, wherein the frame is provided with support and drive means that can engage the rail, wherein the chair is rotatable about a vertical axis relative to the frame between two extreme rotated positions, wherein the chair comprises a seat on which a person can be seated and wherein the chair comprises a footrest on which a person seated on the seat can rest his or her feet. The invention further relates to a chair for a stair lift, which chair comprises frame mounting means for mounting the chair on a frame, wherein the chair is rotatable about a vertical axis relative to the frame between two extreme rotated positions, wherein the chair comprises a seat on which a person can be seated and wherein the chair comprises a footrest on which a person seated on the seat can rest his or her feet.

Such a stair lift, frame and chair for a stair lift are generally known. The chair of the stair lift can rotate about the vertical axis so as to avoid obstacles, such as narrow passages, and/or so as to enable a person seated on the chair to get on and off comfortably at the ends of the stair lift.

If the footrest is located approximately at the level of the support and drive means, unimpeded rotation of the footrest about the vertical axis might lead to the footrest touching the rail at some location, in particular in a bend, along the rail. The extent of the rotation of the chair is limited by this. It is desirable, however, to be able to rotate the chair as far as possible so as to be better able to avoid obstacles along the staircase, such as narrow passages, or in order to enable the person on the chair to get on and off more comfortably at the ends of the stair lift. The object of the invention is to provide a solution to this problem.

In order to achieve that object, the seat and the footrest are rotatable at mutually different angles about the vertical axis. This makes it possible to have the seat rotate further to an extreme position than the footrest, wherein part of the front side of the seat can extend above the rail in the extreme position. For the person seated on the chair it is generally not a problem to place his or her legs slightly at an angle.

The rotation of the footrest is preferably linked to the rotation of the seat via connecting means, wherein, in at least one extreme rotated position of the seat, the footrest has rotated less far to an extreme rotated position than the seat.

The rotation of the seat and that of the footrest between the two extreme rotated positions of the footrest are preferably linked such that the seat and the footrest rotate at the same angle about the vertical axis, wherein the seat can rotate further to the at least one extreme rotated position of the seat, whereas the footrest remains in the at least one extreme rotated position. In this way the difference in rotation only occurs when it is necessary to rotate the seat to the extreme position. The chair preferably comprises drive means which are designed to rotate the seat and the footrest about the vertical axis, and the drive means preferably comprise unlinking means which unlink the rotation of the footrest in the at least one extreme position of the foot rest from the rotation of the seat when the seat rotates further to the at least one extreme position.

Preferably, the at least one extreme rotated position of the footrest can be adjustably set, so that it can be adapted to the situation at the location where the stair lift is installed.

The invention will now be explained in more detail with reference to an embodiment shown in the figures, in which.

Figure 1:
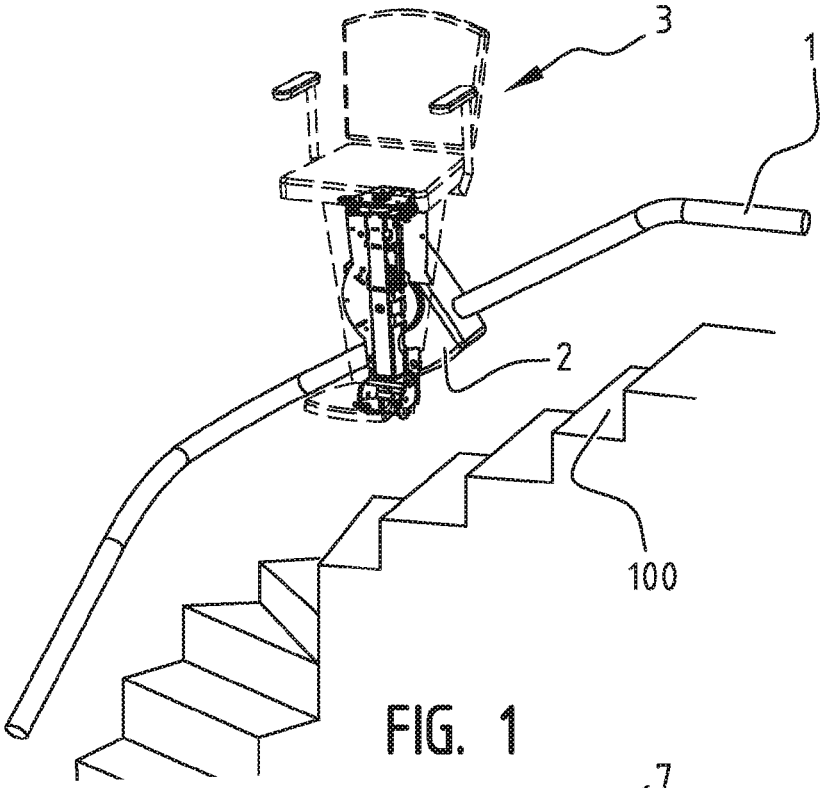
FIG. 1 is a perspective view of a stair lift comprising a frame and a chair.
Figure 2:
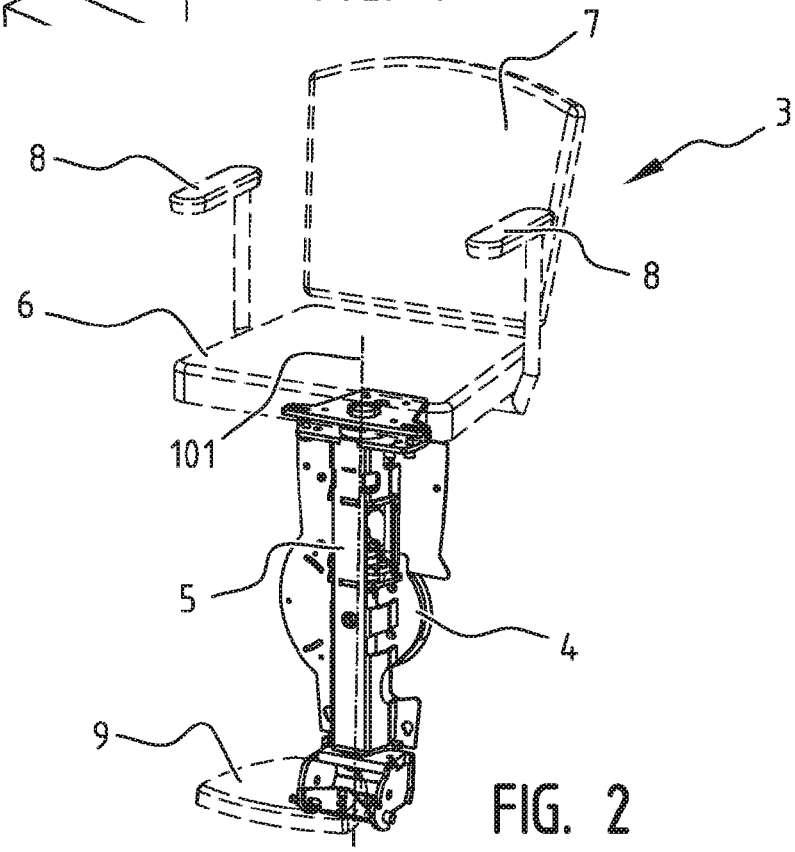
FIG. 2 is a perspective view of the chair of FIG. 1.

According to FIGS. 1 and 2, a stair lift comprises a rail 1, which extends horizontally in part and which is in part mounted at an angle of inclination to the horizontal plane along a staircase 100, and a frame 2 which engages the rail 1 via a support and drive means and which can be moved along said rail, and a chair 3 that is mounted on the frame 2. The chair 3 is mounted on the frame 2 via frame mounting means 4, in such a manner that the chair 3 can be rotated about a horizontal axis so as to be able to keep the chair 3 in a straight position when the angle of inclination of the rail 1 changes.

The chair 3 consists substantially of a chair frame 5, a seat 6, a backrest 7, armrests 8 and a footrest 9 in the form of a plate that extends in the horizontal plane.

Figure 3:
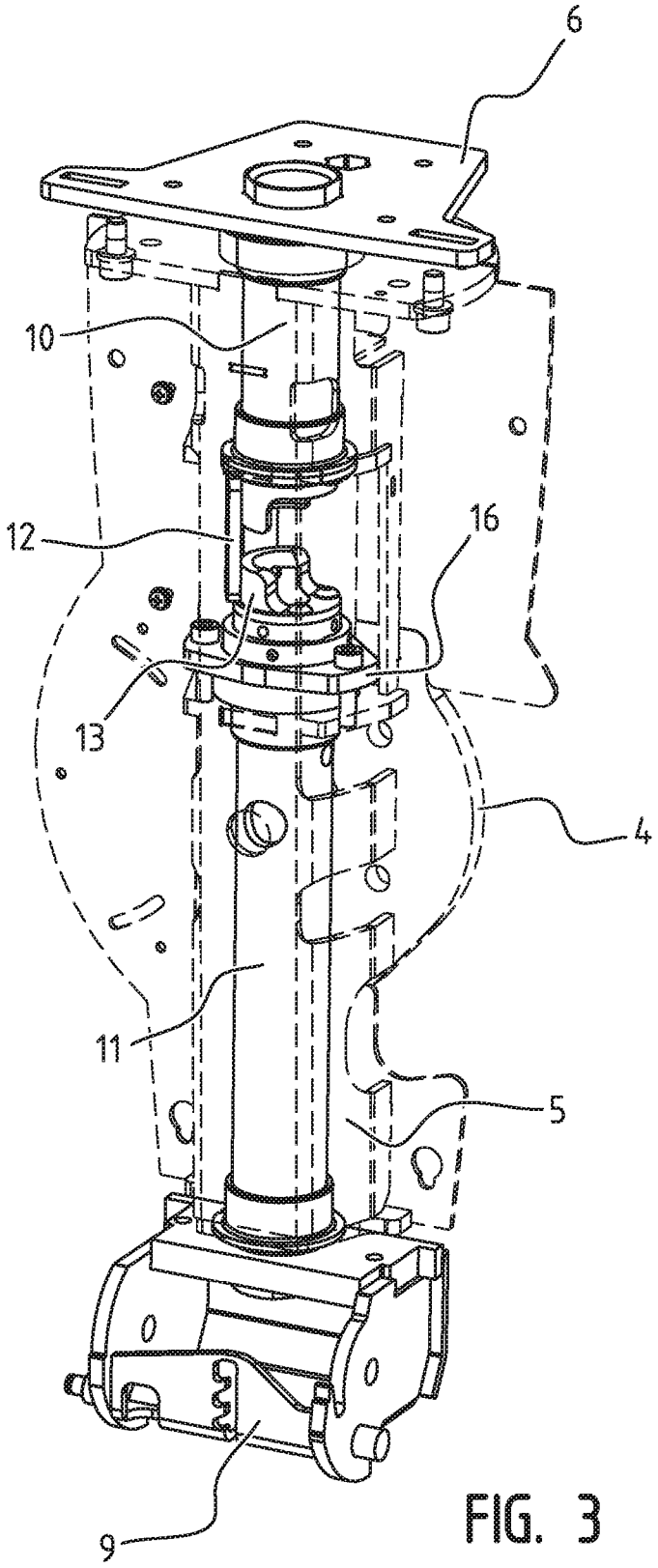
FIG. 3 is a perspective view of the rotation drive mechanism of the chair of FIG. 1.
Figure 4:
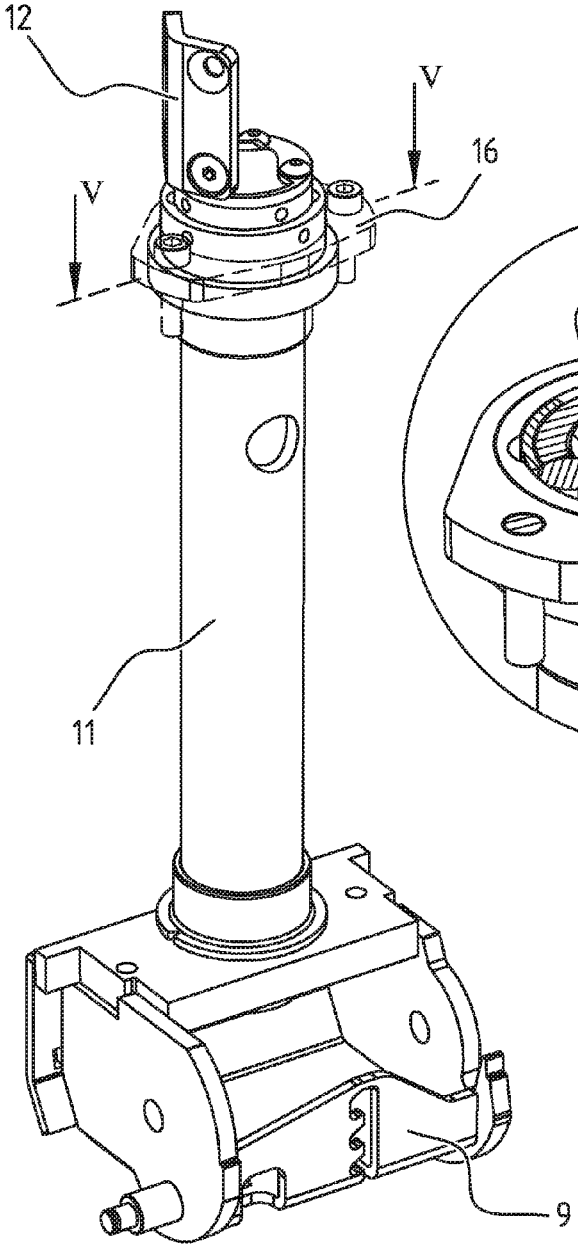
FIG. 4 is a perspective view of part of the rotation drive mechanism of the chair of FIG. 1.
Figure 5:
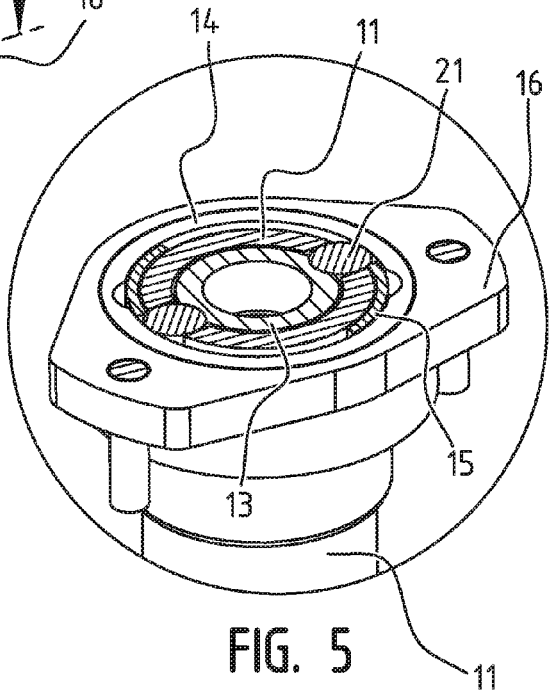
FIG. 5 is a perspective view of a detail according to the arrows V-V in FIG. 4 of the rotation drive mechanism of the chair of FIG. 1.
Figure 6:
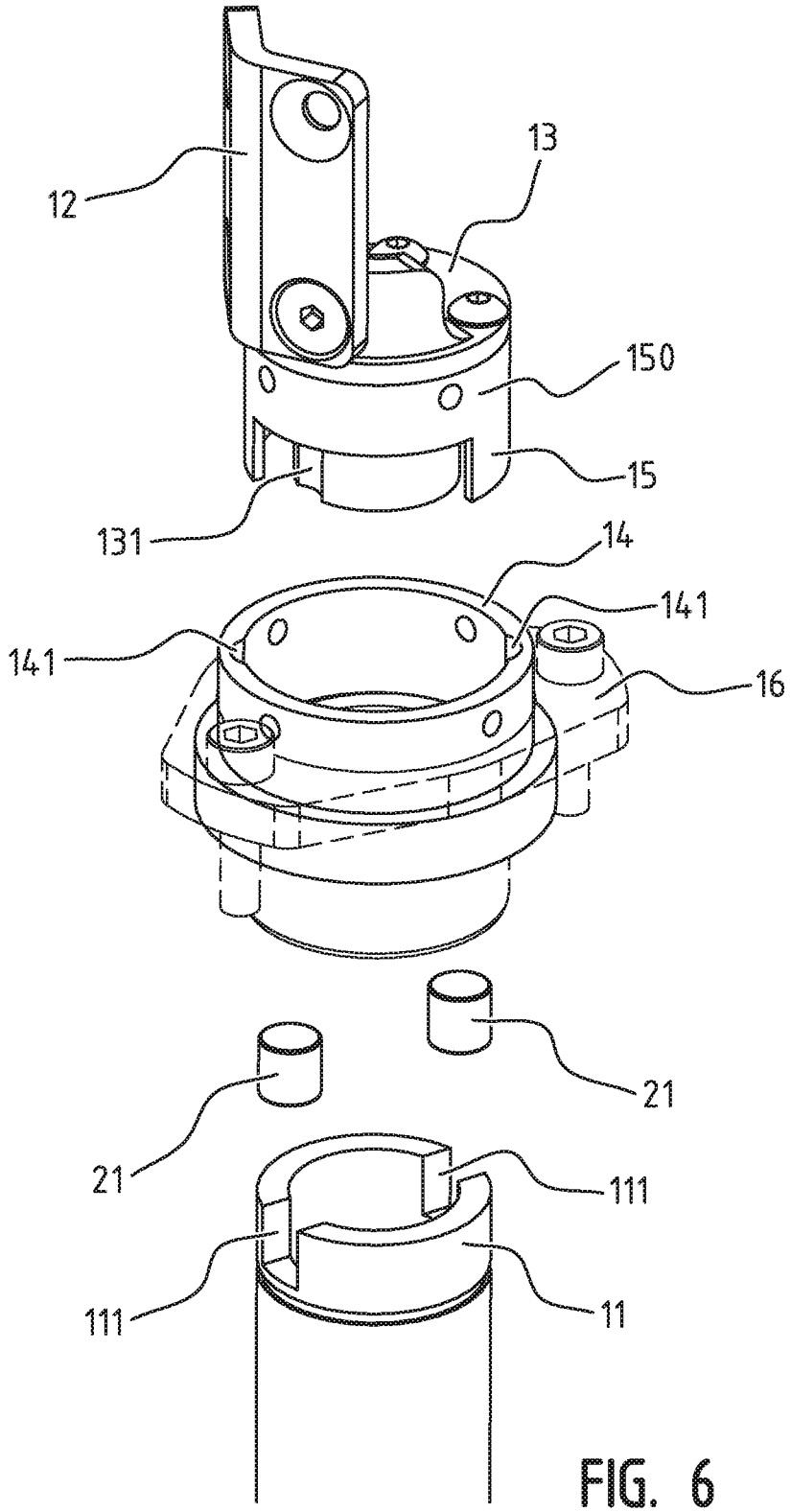
FIG. 6 is an exploded view of part of the rotation drive mechanism of the chair of FIG. 1.

In FIGS. 3 and 4, the only parts of the seat 6 and the footrest 9 that are shown are the respective means of attachment thereof to the connecting mechanism.

The seat 6, with the backrest 7 and the armrests 8, is mounted to the top end of an upper shaft 10. The footrest 9 is hingedly mounted to the bottom end of a lower shaft 11. Both shafts 10, 11 are rotatably mounted in the chair frame 5, wherein the upper shaft is connected to an electric motor, which causes the seat to rotate. The upper shaft 10 is connected to the lower shaft by means of a connecting mechanism as described below.

With reference to FIGS. 3, 4, 5 and 6, a driver 13 is mounted to the upper shaft 10, on which the seat 6 is mounted, via the mounting part 12. The driver 13 comprises a downwardly extending cylindrical outer wall, in which two part-cylindrical recesses 131 are formed (see FIG. 6). Arranged around the cylindrical outer wall of the driver 13 is the hollow tubular upper end of the shaft 11 of the footrest. Two recesses 111 are formed in the wall of said end, in which recesses two rollers 21 are present, whose axes extend vertically. A cylinder 14 is arranged around the tubular upper end of the shaft 11, which cylinder is provided with two part-cylindrical recesses 141 on the inner side. The circumferential walls of the part-cylindrical recesses 131, 141 correspond to the circumferential walls of the rollers 21. Between the ring 14 and the shaft 11, two push-out cylinder parts 15 extend, which are mounted to a ring 150 that is fixed to the driver 13.

The ring 14, the hollow tubular upper end of the shaft 11, the cylindrical wall of the driver 13 and the push-out cylinder parts 15 all extend concentrically in a circular bore of a flange 16 that is attached to the chair frame 5.

Figure 7:
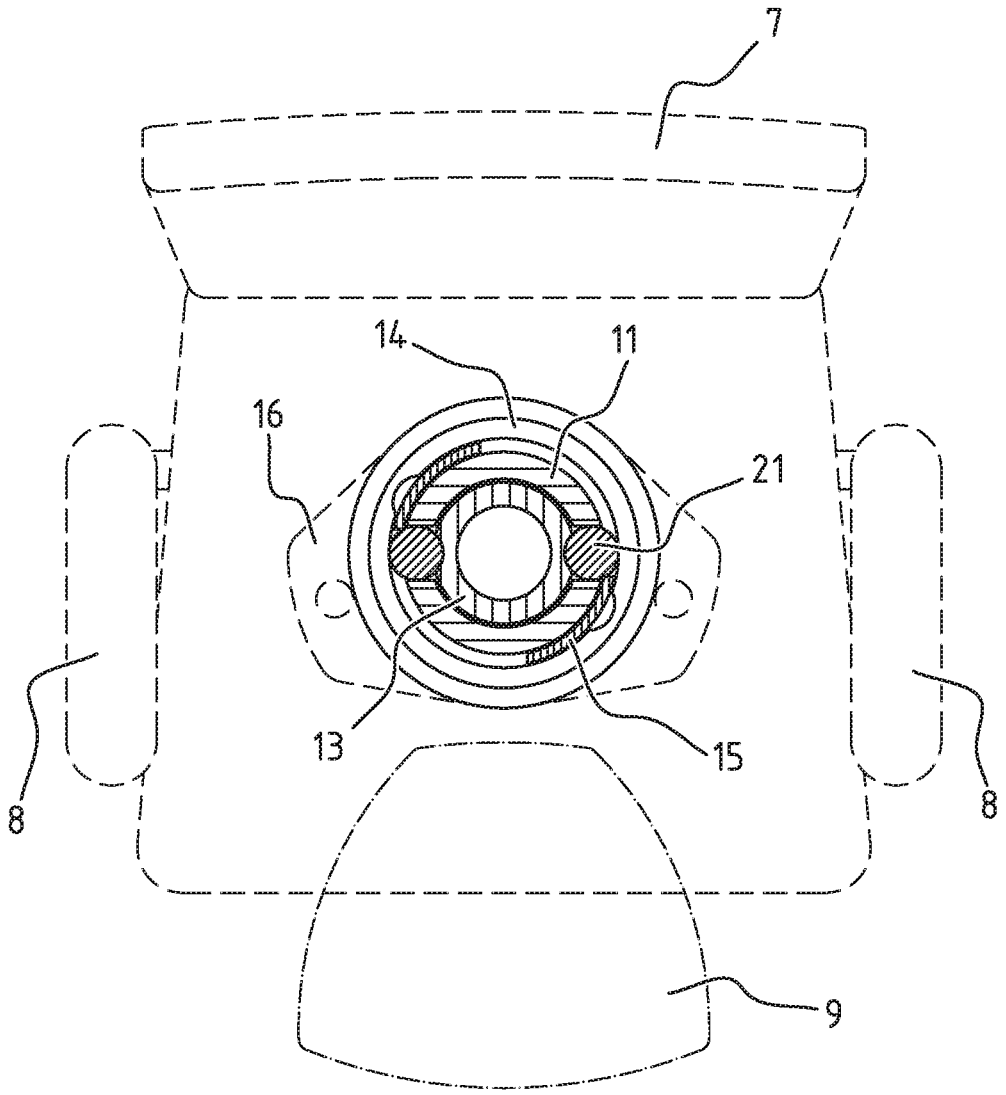
FIGS. 7, 8 and 9 are top plan views of the chair of FIG. 1.

In the situation shown in FIG. 7, the ring 14 pushes the rollers 21 into the recesses 131 of the driver 13, and the driver 13 will drive the shaft 11 to which the footrest 9 is mounted, such that the footrest 9 and the chair seat 6 rotate synchronously about their respective shafts 10, 11 around axis 101 (see FIG. 2).

Figure 8:
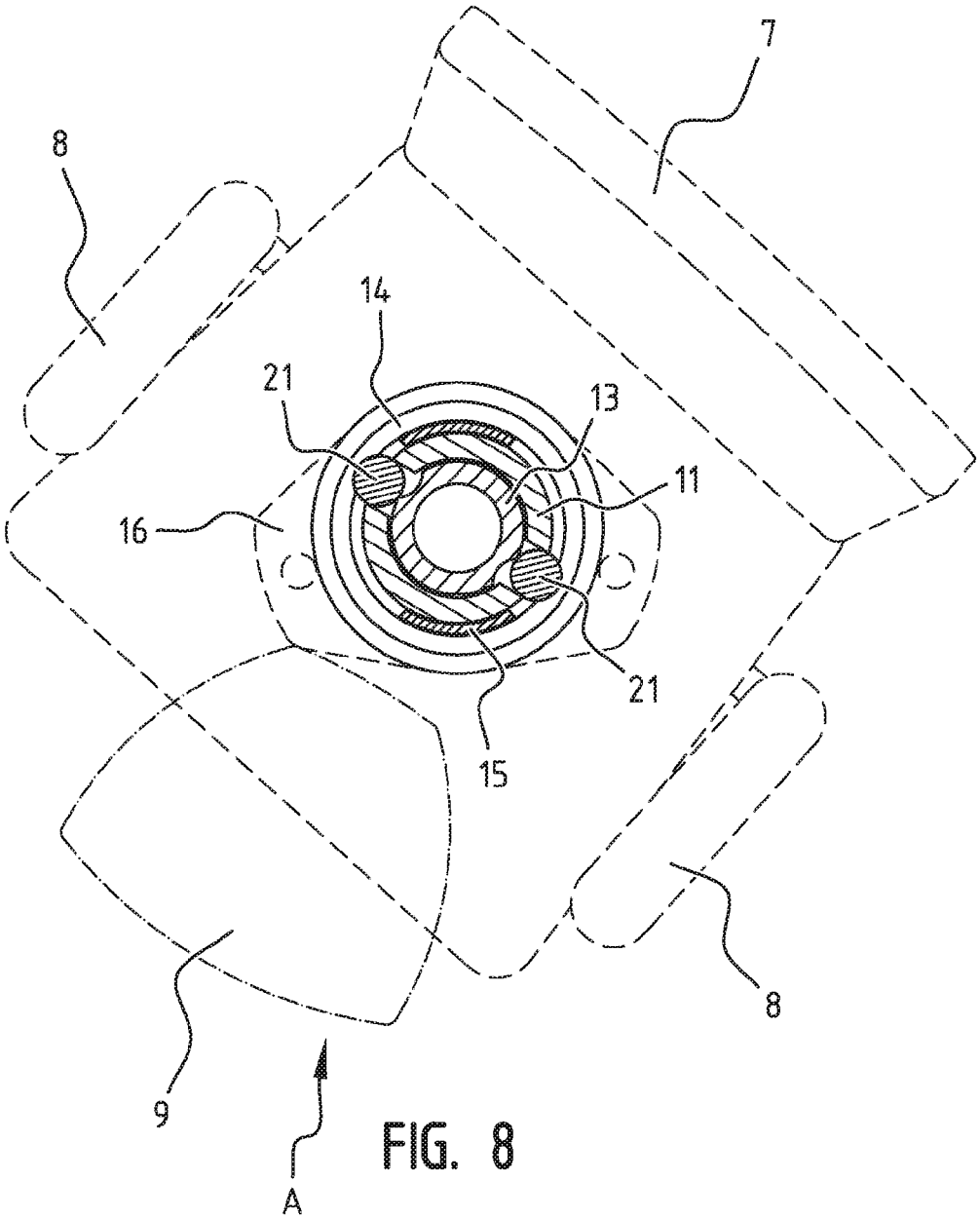
Figure 9:
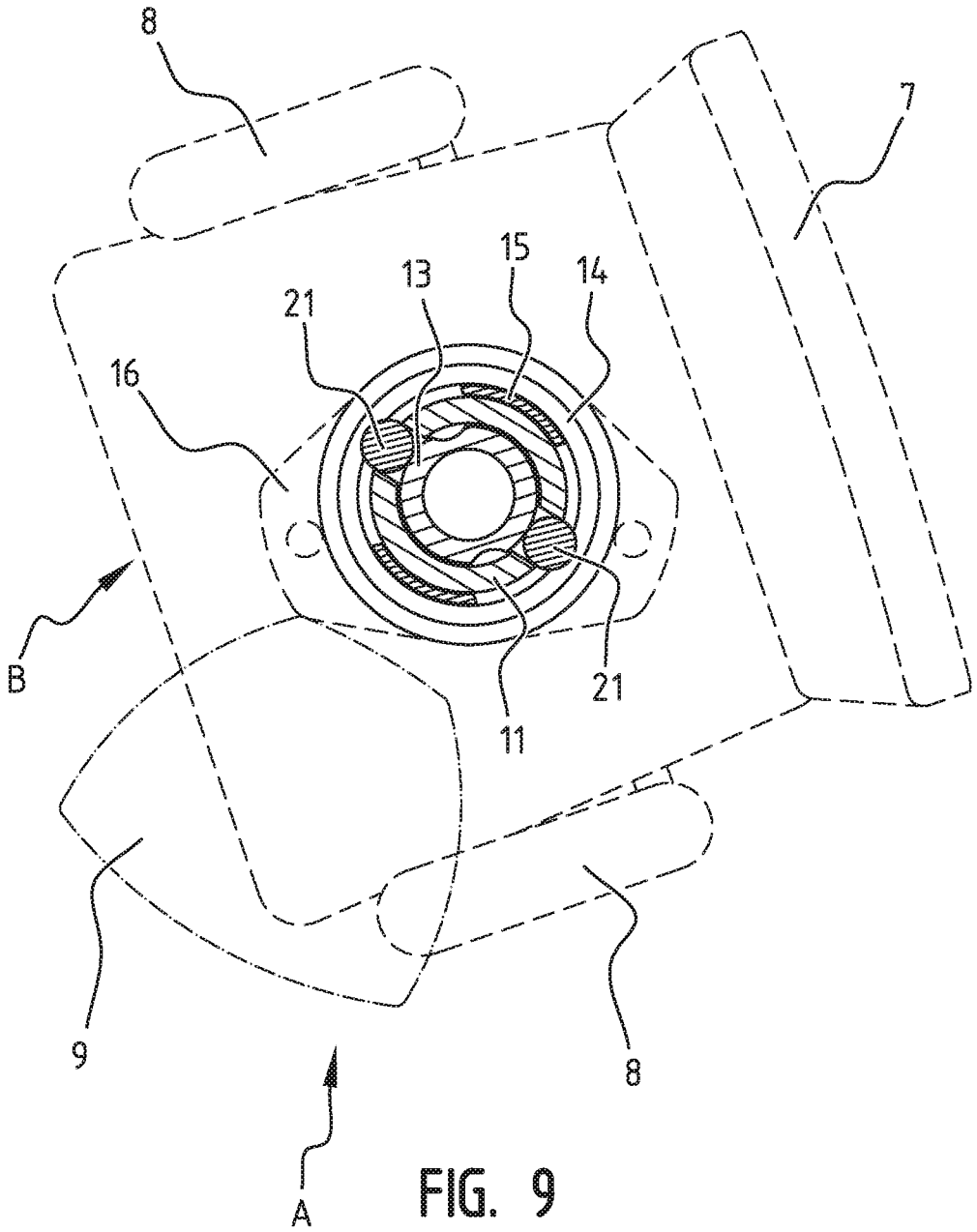

In the situation shown in FIG. 8, in which the disconnecting is reached, the rollers 21 can move out of the recesses 131 of the driver and into the recesses 141 in the wall of the cylinder 14, as a result of which the driver 13 with the shaft of the seat becomes disconnected from the shaft 11 with the footrest 9, so that the footrest 9 cannot rotate further than its maximum rotated position A as shown in FIGS. 8 and 9 upon continued rotation of the shaft with the seat 6 to its maximum rotated position B as shown in FIG. 9.

According to FIG. 9, the push-out cylinder parts 15 will push the rollers back into the part-cylindrical recesses in the driver 13 when the shaft with the seat 6 and the driver rotates back, as a result of which the driver 13 and the shaft 11 of the footrest 9 will become reconnected again and rotate back synchronously.

The footrest is configured to have at least one of its said two maximum rotated positions of the footrest adjustably set. To the end the position of the ring 14 around the shafts 10, 11 relative to the outer cylinder 16 is adjustable, so that the disconnecting point, and thus the extreme position of the footrest 9, is adjustable.

The invention claimed is:

1. A stair lift comprising:

a rail which is mounted along a staircase, at least partially at an angle to a horizontal plane; and a frame which is movable along the rail, on which a chair is mounted, which frame engages the rail, wherein the chair comprises a seat on which a person can be seated and wherein the chair comprises a footrest on which the person seated on the seat can rest his or her feet, wherein the seat and the footrest are each rotatable at mutually different angles about a vertical axis between two maximum rotated positions relative to the vertical axis, wherein the footrest is coupled to the seat via a coupling means, and wherein at least one of the two maximum rotated positions of the footrest relative to the vertical axis is less than at least one of the two maximum rotated positions of the seat relative to the vertical axis.

2. The stair lift according to claim 1, wherein the seat and the footrest are coupled via said coupling means in such a manner that the seat and the footrest rotate together at the same angle about the vertical axis, but wherein the seat is allowed to rotate further beyond at least one of the maximum rotated positions of the footrest relative to the vertical axis to at least one of the maximum rotated positions of the seat.

3. The stair lift according to claim 1, wherein the footrest is configured to have at least one of its said two maximum rotated positions be adjustably set.

4. A frame for a stair lift, which frame is movable along a rail which is mounted along a staircase at least partially at an angle to a horizontal plane, on which frame a chair is mounted, wherein the frame can engage the rail, wherein the chair comprises a seat on which a person can be seated and wherein the chair comprises a footrest on which the person seated on the seat can rest his or her feet, wherein the seat and the footrest are each rotatable at mutually different angles about a vertical axis between two maximum rotated positions relative to the vertical axis, wherein the footrest is coupled to the seat via a coupling means, and wherein at least one of said two maximum rotated positions of the footrest relative to the vertical axis is less than at least one of the two maximum rotated positions of the seat relative to the vertical axis.

5. A chair for a stair lift, which chair comprises frame mounting means for mounting the chair on a frame, which frame is movable along a rail which is mounted along a staircase at least partially at an angle to a horizontal plane, wherein the chair comprises a seat on which a person can be seated and wherein the chair comprises a footrest on which the person seated on the seat can rest his or her feet, wherein the seat and the footrest are each rotatable at mutually different angles about a vertical axis between two maximum rotated positions relative to the vertical axis, wherein the footrest is coupled to the seat via a coupling means, and wherein at least one of said two maximum rotated positions of the footrest relative to the vertical axis is less than at least one of the two maximum rotated positions of the seat relative to the vertical axis.

* * * * *